United States Patent [19]

Riske et al.

[11] Patent Number: 4,909,765

[45] Date of Patent: Mar. 20, 1990

[54] REMOTE STEERING DEVICE FOR BOATS

[76] Inventors: Earl G. Riske, 34055 Lotties Dr., New Baltimore, Mich. 48047; Raymond J. Mohr, 42526 Freeport Dr., Sterling Heights, Mich. 48078; James E. McFadden, 8551 Colony Dr., Algonac, Mich. 48001; Rudy Lapps, 22444 Remick, Mt. Clemens, Mich. 48043

[21] Appl. No.: 258,784

[22] Filed: Oct. 17, 1988

Related U.S. Application Data

[63] Continuation-in-part of Ser. No. 70,530, Jul. 7, 1987, abandoned.

[51] Int. Cl.[4] ..... B63H 21/26

[52] U.S. Cl. ..... 440/59; 114/144 R; 192/141; 192/143; 440/53

[58] Field of Search ..... 114/144 R; 440/53, 58, 440/59, 60, 61, 62, 63; 192/141, 143

[56] References Cited

U.S. PATENT DOCUMENTS

| | | | |
|---|---|---|---|
| 2,253,757 | 8/1941 | Bagatti | 440/59 |
| 2,417,434 | 3/1947 | Mead et al. | 192/143 |
| 2,804,838 | 9/1957 | Moser . | |
| 2,972,328 | 2/1961 | Hodgson | 440/59 |
| 3,121,415 | 2/1964 | Anderson et al. | 440/59 |
| 3,283,738 | 11/1966 | Nelsen . | |
| 3,326,054 | 6/1967 | Canick et al. | 192/141 |
| 3,593,829 | 7/1971 | Williams | 192/141 |
| 3,763,819 | 10/1973 | Mays . | |
| 3,881,443 | 5/1975 | Hamp . | |
| 4,114,747 | 9/1978 | Eller | 192/143 |
| 4,373,920 | 2/1983 | Hall et al. | 440/59 |
| 4,573,930 | 3/1986 | Queen | 440/63 |
| 4,654,014 | 3/1987 | Peirce et al. | 440/59 |
| 4,666,026 | 5/1987 | Paulin | 129/143 |

FOREIGN PATENT DOCUMENTS

| | | | |
|---|---|---|---|
| 2441540 | 7/1980 | France | 440/59 |

*Primary Examiner*—Sherman D. Basinger
*Assistant Examiner*—Thomas J. Brahan
*Attorney, Agent, or Firm*—Harness, Dickey & Pierce

[57] ABSTRACT

An auxiliary steering device for outboard motors is disclosed. The auxiliary steering device includes an elongated housing defining a longitudinal axis. A reciprocating moving mechanism is coupled with the elongated housing for movement along a line defined by the longitudinal axis. A motor is coupled with the moving mechanism to reciprocatingly drive the moving mechanism along a line defined by the longitudinal axis. A tie rod is coupled with the moving mechanism and the outboard motor to pivot the outboard motor which, in turn, steers the boat in response to the movement of the moving mechanism along the line defined by the longitudinal axis. A controller is also associated with the motor and a mechanism for limiting movement of the reciprocating moving member along the longitudinal axis is provided to limit movement in both directions along the line defined by the longitudinal axis.

12 Claims, 4 Drawing Sheets

FIG. 1.
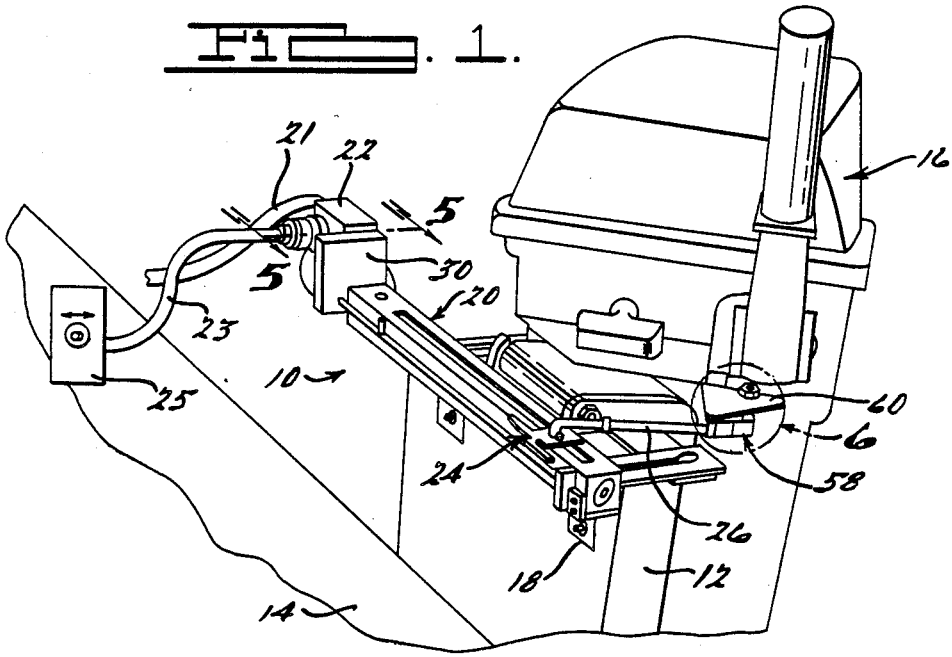
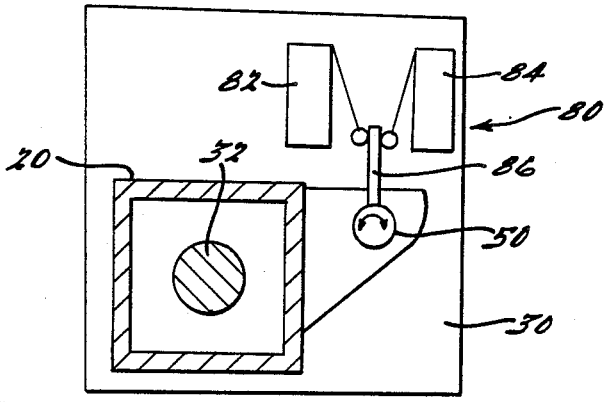
FIG. 5.
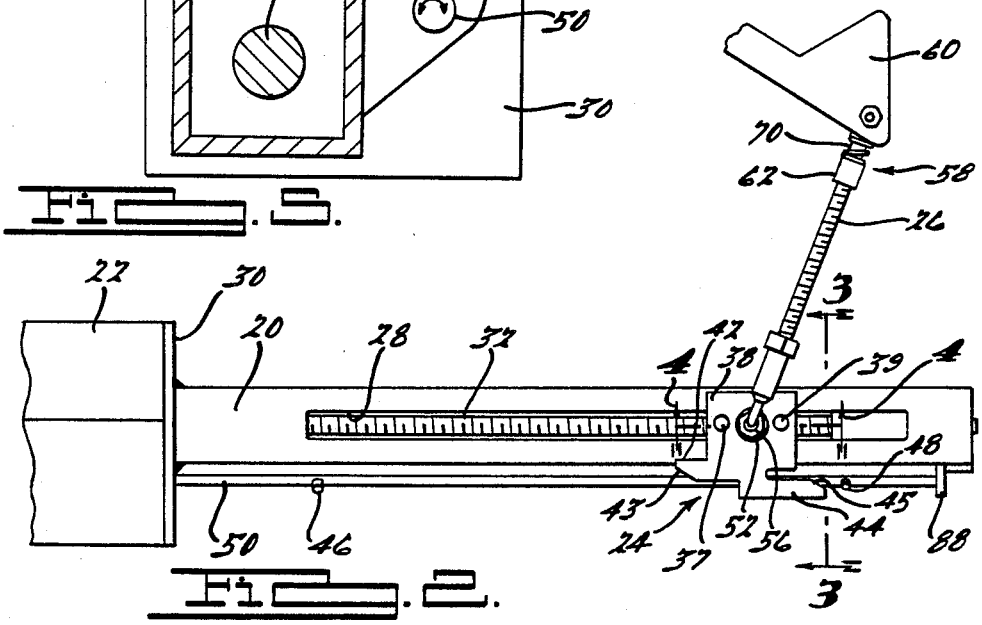
FIG. 2.

REMOTE STEERING DEVICE FOR BOATS

RELATED APPLICATIONS

This is a continuation-in-part application of U.S. Pat. Application Ser. No. 070,530, filed Jul. 7, 1987, now abandoned, the specification of which is herein expressly incorporated by reference.

BACKGROUND AND SUMMARY OF THE INVENTION

The present invention relates to steering of boats and, more particularly, to controlling the steering of an outboard trolling motor.

Inboard and outboard powered boats generally are supplied with a large engine for powering the boat under normal circumstances. These large engines are not practical for slow travel, as is necessary when fishing of merely following along a shoreline. It is very common for such a boat to be equipped with a second outboard engine smaller than the first and mounted on the main transom or in the alternative on an auxiliary transom that is carried on the main transom to which the larger motor is mounted. Often, the smaller engine is mounted at a location lower than the main transom which makes it difficult to use the conventional steering mechanism to provide for manual steering of the trolling motor. Thus, there is a need in the field for a remote control steering device for a trolling motor mounted to these types of boats.

The art provides several types of steering mechanisms for boat motors. U.S. Pat. Nos. 2,804,838; 3,283,738; 3,763,819; 3,881,443; 3,121,415; 4,373,920 illustrate different types of devices used to steer outboard marine motors. While these devices illustrate means for the steering of outboard motors, they have several disadvantages. One disadvantage is that the above-identified steering attachments are very complicated. Another disadvantage is that these steering attachments are not readily attachable and detachable to the auxiliary trolling motors.

Accordingly, it is an object of the present invention to overcome the disadvantages of the above art. The present invention provides the art with a steering attachment for a trolling motor that is of a simple construction and readily securable and removable to the main transom or auxiliary transom and to the outboard motor. Also, the present invention provides the art with a remote control steering device that limits the movement of the outboard trolling motor which, in turn, controls the path of the boat.

Additional objects and advantages of the present invention will become apparent from the reading of the detailed description of the preferred embodiment, which makes reference to the accompanying drawings.

BRIEF DESCRIPTION OF THE DRAWINGS

FIG. 1 is a perspective view of a steering device in accordance with the present invention.

FIG. 2 is a top plan view of the device of FIG. 1.

FIG. 6 is an enlarged breakaway perspective view of the components within circle 6.

DETAILED DESCRIPTION OF THE PREFERRED EMBODIMENTS

Figure 3:
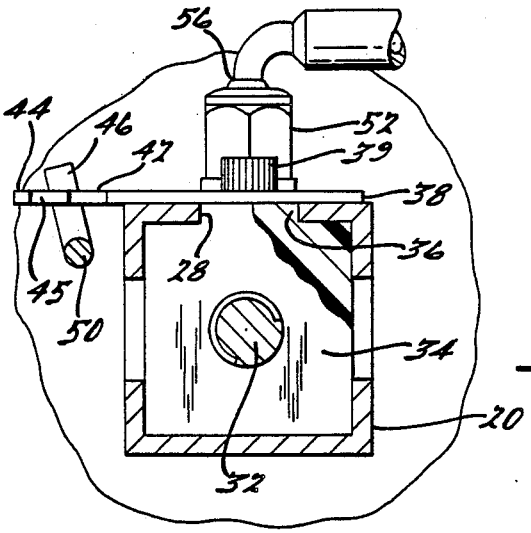
FIG. 3 is a cross-section view of FIG. 2 along line 3—3.

Turning to the figures, a remote steering device for outboard motors is illustrated and designated with the reference numeral 10. FIG. 1 illustrates the remote steering device 10 mounted on an auxiliary transom 12 of a boat 14. The steering device 10 is coupled with an outboard motor 16 to direct the outboard motor in a path which, in turn, steers the boat along its path.

The steering device 10 includes a bracket 18 to secure the steering device 10 onto the auxiliary transom 12. An elongated housing 20 is secured to the bracket 18. A motor 22 to drive a motive assembly 24 within the housing 20 is coupled with the housing at one of its ends. Supply cord 21 is coupled with the boat battery to provide power to the motor 22. Cord 23 is coupled with a remote control 25 which controls the reciprocating movement of the motive assembly 24 along the housing 20. A tie rod 26 is coupled with the motive assembly 24 and the motor 16 to provide the motor 16 with movement which, in turn, steers the boat.

Figure 4:
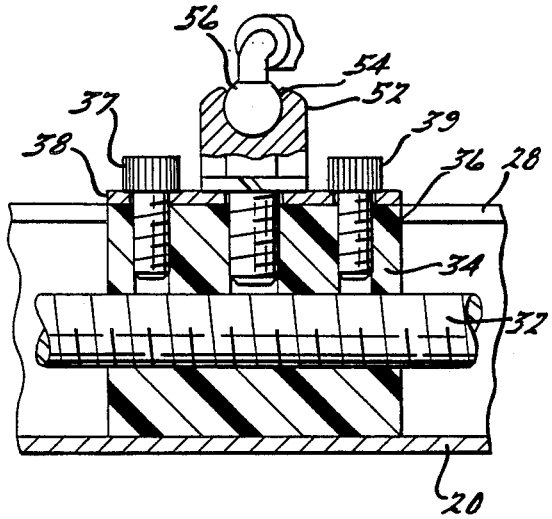
FIG. 4 is a cross-section view of FIG. 2 along line 4—4 thereof.

Moving to FIGS. 2 through 4, a better understanding of the steering device 10 may be procured. The housing 20 is generally an elongated hollow rectangular tube having a slot 28 on its top wall. A support plate 30 is secured at one end of the housing 20 to provide attachment of the motor 22 to the housing 20.

The motive assembly 24 includes a screw member 32 rotatably coupled in the housing 20. The screw member 32 is coupled for rotation with the reversible DC motor 22. The screw member 32 is threadably engaged with a drive slider 34. The drive slider 34 reciprocates along the longitudinal axis of the screw member 32 in response to clockwise and counterclockwise rotation of the screw member 32.

The drive slider 34 has a portion 36 which projects through the slot 28 of the housing 20 as best seen in FIGS. 3 and 4. The projecting portion 36 has a plate member 38 coupled therewith by fasteners 37 and 39. The plate member 38 has an overall rectangular shape with a pair of fingers 42 and 44 projecting off one of the longitudinal sides in opposite directions with respect to one another as seen in FIG. 2. The fingers 42 and 44 contact prongs 46 and 48, which are connected to the rod member 50, to limit the reciprocating movement of the drive slider 34 as will be discussed herein.

A fitting 52 having a ball socket 54 is secured into the projecting portion 36 of the drive slider 34. The ball socket 54 receives a ball joint 56 which is connected to the tie rod 26. The ball joint 56 enables the tie rod 26 to move in multiple directions in response to the reciprocating movement of the drive slider 34 which, in turn, pivots the motor 16 to steer the boat 14.

The tie rod 26 has a coupling 58 on its other end which secures the tie rod 26 to a bracket 60 as seen in FIG. 6. The bracket 60 is secured to the outboard motor 16 to connect the steering device 10 with the outboard motor 16. The coupling 58 is of the quick connect type having a collar 62 readily received onto the tie rod 26. The collar 62 has an aperture 64 to receive a ball joint 66 connected to the bracket 60. A slip sleeve 68 is slideably retained on the collar 62 and biases against a spring 70 to enable movement of the sleeve 68 to provide insertion and removal of the ball joint 66 from the collar aperture 64. The slip sleeve 68 has a slot 72 which engages the ball joint 66 locking the ball joint 66 in the collar aperture 64.

Figure 5:
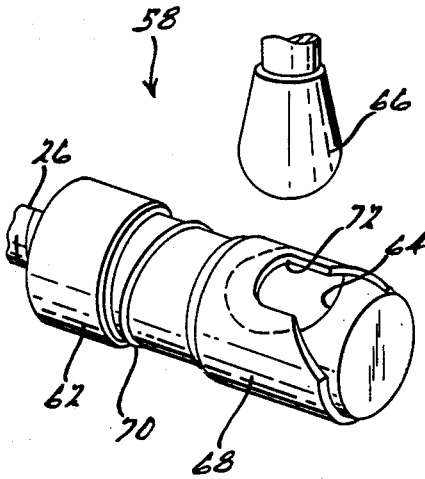
FIG. 5 is a cross-section view of FIG. 1 along line 5—5 thereof.

An assembly 80 to limit the reciprocating movement of the slider 34 along the screw member 32 is associated with the rod member 50. The assembly 80 includes a pair of micro switches 82 and 84 associated with an activation member 86, projecting from the rod 50, sandwiched between the switches 82 and 84 as seen in FIG. 5. The limiting micro switches 82 and 84 are generally mounted on the support plate 30 and are protected from the element by a motor housing.

The limiting mechanism 80 ordinarily functions as follows. The motor 22 rotates the screw member 32 in a clockwise or counterclockwise rotation which, in turn, moves the drive slider 34 in a reciprocating path along a line defined by the longitudinal axis of the screw member 32 and housing 20. As the drive slider 34 moves, the motor 16 pivots, via the tie rod 26, steering the boat along its path.

As the drive slider 34 is driven towards the end of its path in either direction along the screw member 32 the fingers 42 and 44 of plate 38 contact prong members 46 and 48 on rod 50. Rod 50 which is rotatably coupled with support plate 30 and support 88 rotates within the supports when the fingers 42 and 44 contact prong members 46 and 48, respectively. As finger 42 contacts prong member 46, the prong 46 is rotated away from the housing 20 due to the finger's angled face 43 pushing on the prong 46. The rod 50, in turn, is rotated clockwise which, in turn, pivots activation member 86 to contact micro switch 84 terminating power to the motor 22 and halting movement of the slider 34 in that direction. The remote controller 25 is activated to reverse the motor 22 which, in turn, drives the screw member 32 in the opposite direction.

As the drive slider 34 and plate 38 moves along the housing 20 and screw member 32, finger 44 eventually contacts prong member 48. As this happens, prong member 48 is drawn towards the housing 20 due to the finger's angled face 45 pulling on the prong 48. The rod 50 is rotated counterclockwise which, in turn, pivots activation member 86 to contact micro switch 82 terminating power to the motor 22 and halting movement of the drive slider 34 in that direction. Further, the operator may control the reciprocating movement of the drive slider 34 at his leisure to control the path of the boat prior to the termination of the power to the motor as described above.

Figure 7:
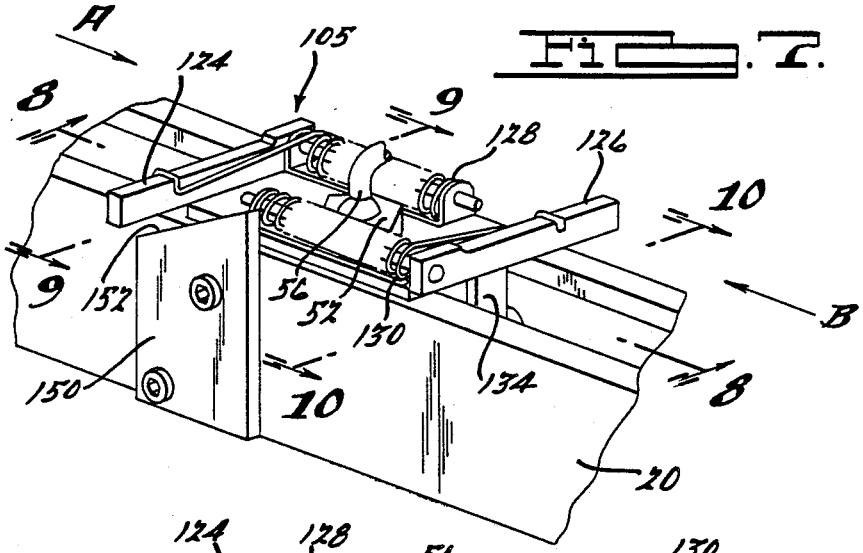
FIG. 7 is a partial perspective view of the second embodiment of the present invention.
Figure 8:
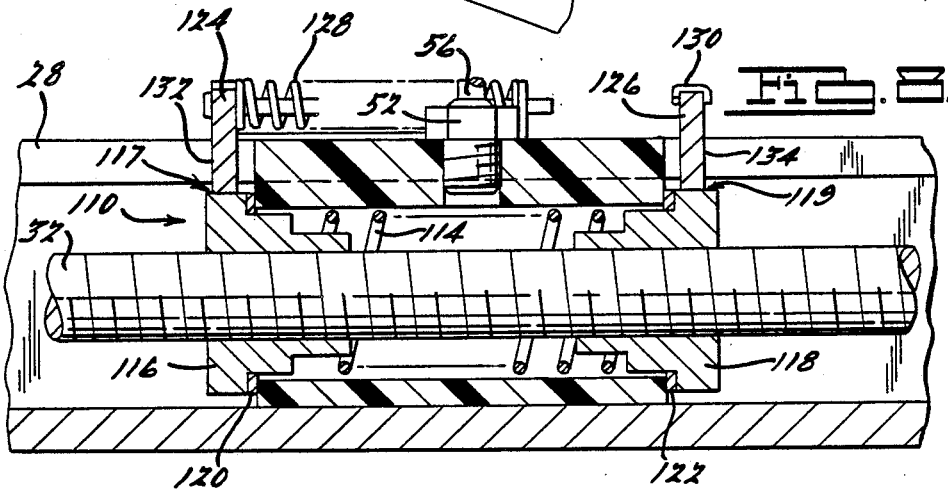
FIG. 8 is a cross-section view of FIG. 7 along line 8—8 thereof.

Moving to FIGS. 7 through 10, a second embodiment of the present invention is illustrated. FIG. 7 illustrates a partial perspective view of a motive clutch assembly 105 utilized to drive a slider 110 in the housing 20.

The slider 110 includes a main body 112 having a compression spring 114 and two drive nuts 116 and 118. Also, a pair of slip washers 120 and 122 are positioned between the drive nuts 116 and 118 and the main body 112. The screw member 32 threadably engages the drive nuts 116 and 118 on each side of the main body 112. The compression spring 114 exerts force on the drive nuts 116 and 118 to enable movement of the slider 110.

A pair of dog members 124 and 126 are positioned on plate 125 which is secured to the slider 110. The dogs 124 and 126 are resiliently biased by compression springs 128 and 130. The dog members 124 and 126 have projecting portions 132 and 134, respectively, which nest on the cam surfaces 117 and 119 of the drive nut 116 and 118 as best seen in FIG. 9 and 10.

Figure 9:
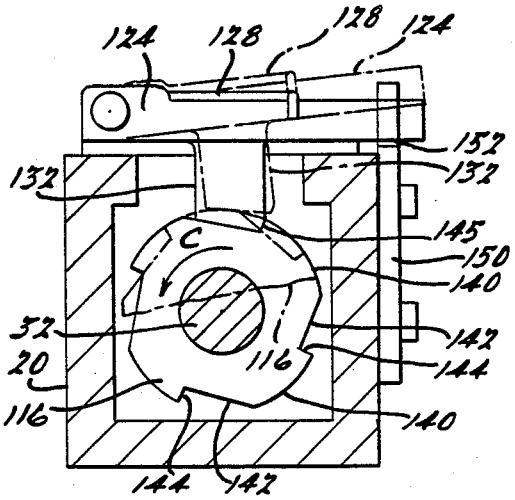
FIG. 9 is a cross-section view of FIG. 7 along line 9—9 thereof.
Figure 10:
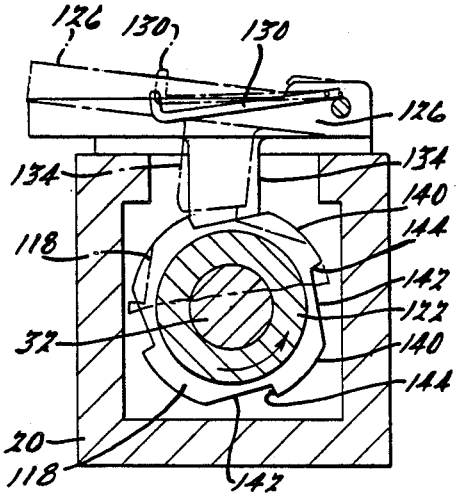
FIG. 10 is a cross-section view of FIG. 7 along line 10—10 thereof.
Figure 11:
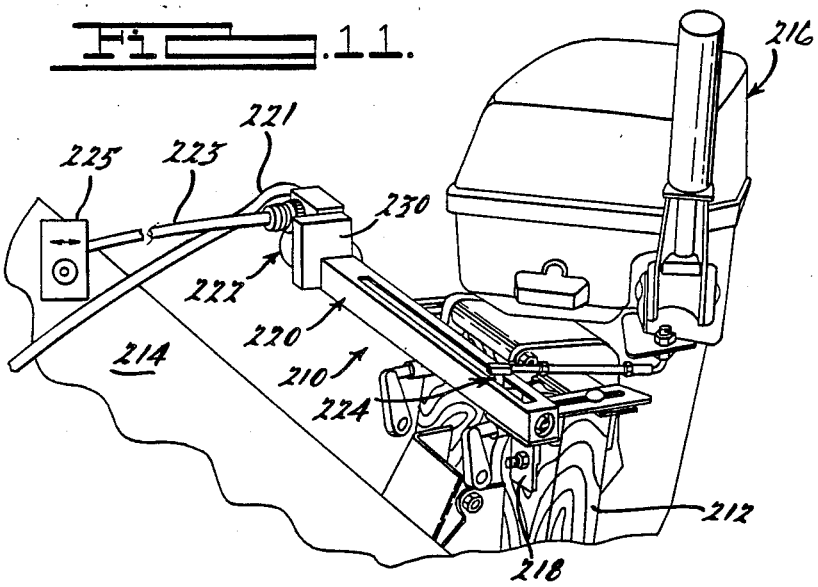
FIG. 11 is a perspective view of another steering device in accordance with the present invention.
Figure 12:
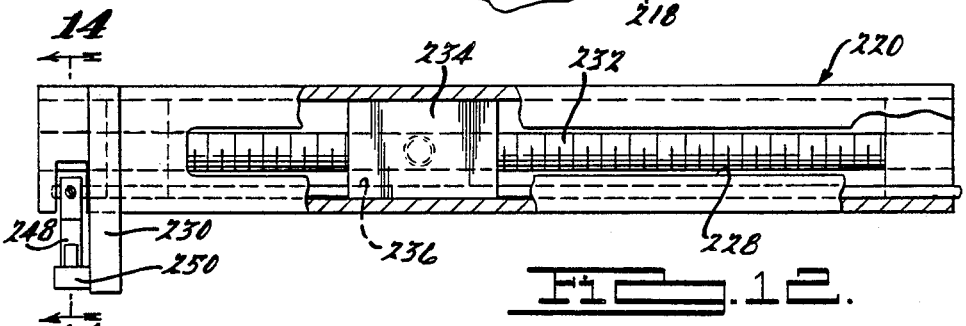
FIG. 12 is a top plan view partially in cross-section of FIG. 11.

Moving to FIGS. 9 and 10, side elevation views of the drive nuts 116 and 118 are shown. The drive nuts 116 and 118 have several arcuate 140 and planar 142 surfaces on their cam surfaces 117 and 119. Also, stops 144, substantially perpendicular to the planar surfaces 142, are positioned to join each arcuate surface 140 with the successive planar surface 142. The cam surface 117 and 119 of the drive nuts 116 and 118 are substantially identical, however, when positioned on the screw member 32, as viewed along arrow A in FIGS. 9 and 10, one of the stops 145 of drive nut 116 is in contact with dog 124 to drive the drive slider 110 in the direction of arrow A along screw member 32 (FIG. 9) while the other drive nut 118 is in an idling position not driven by the dog 126 (FIG. 10). Thus, the drive slider 110 reciprocates along the screw member 32 in response to rotation of the screw member 32.

An explanation of movement along the screw member 32 will be given in only one direction. It is noted that reverse movement of the drive slider 110 is accomplished in a similar fashion with the dogs and drive nuts reversed.

As the drive slider 110 moves along the screw member 32, in the direction of arrow A, dog 124 is engaged with drive nut 116 to move drive slider 110 in the direction of arrow A and dog 126 is disengaged with driver nut 118. As the drive slider 110 reaches the end of its travel, dog 124 contacts a projecting member 150. Projecting members 150 are positioned in similar places like prong members 46 and 48 and provide a synonymous function to limit the movement of the slider 110 along the screw member 32.

Turning to FIGS. 9 and 10, an explanation of the contacting of a projection member 150 will be described. In FIG. 9 the screw member 32 is rotated in the direction of the arrow C (clockwise) which, in turn, moves the motive clutch assembly 105 in the direction of arrow A, in FIG. 7. The extended portion 132 of the dog 124 contacts stop 145 to drive the motive clutch assembly 105 in the direction of arrow A. As the dog 124 contacts the projecting member 15 the dog 124 begins to slide and rise on the slanted surface 152 of projecting member 150 and portion 132 disengages with the stop 145 and ceases to drive the motive clutch assembly 105 along arrow A as seen in phantom in FIG. 9. While this occurs, idler dog 126 is out of driving engagement with stop 144, due to the rotation direction of the screw member 32, and cam surface 119 rotates underneath the dog 126 as shown in phantom in FIG. 10. The dog 126 pivots up and down along the cam surface 119 of drive nut 118 as the successive arcuate 140 and planar 142 surface pass under to dog portion 134 making a clicking noise notifying the operator that the motive clutch assembly 105 has reached its limit along the screw member 32 in that direction. Thus, as the screw member 32 continues to rotate, the stops 144 do not contact the extended portion 132 of the dog 124 and, therefore, the drive nut 116 ceases to continue to rotate and move the slider 110 in the direction of arrow A. When the direction is reversed along arrow B, the motive clutch assembly 105 operates in a reverse direction as has been explained above with the dogs and drive nuts substituted for one another.

Turning to FIGS. 11–14, a second embodiment of the present invention is illustrated. A steering device 210 is mounted on an auxiliary transom 212 of a boat 214. The steering device 210 is coupled with an outboard motor 216 to direct the outboard motor in a path which, in turn, steers the boat along its path. The steering device 210 includes a bracket 218 to stationarily secure the steering device 210 to the auxiliary transom 212. A housing 220 is secured to the bracket 218. A motor 222, which drives the motive assembly 224 within the housing 220 is coupled at one end of the housing 220. A supply cord 221 is coupled with the boat battery to provide power to the motor 222. A cord 223 is coupled with the remote control 225 which controls the reciprocating movement of the motive assembly 224 along the housing 220. A tie rod 226 is coupled with the motive assembly 224 to provide the outboard motor 216 with movement which, in turn, steers the boat. The tie rod 226 generally snap fits into the actuator nut 234 by a mechanical or friction fit.

The housing 220 is generally an elongated hollow rectangular tube having a slot 228 on its top wall. A support plate 230 is secured at one end of the housing 220 to provide attachment of the motor 222 to the housing 20. The motive assembly 224 includes a screw 232 rotatably coupled within the housing 220. The screw member 232 ~~is~~ rotationally coupled with a reversible DC motor 222.

Figure 13:
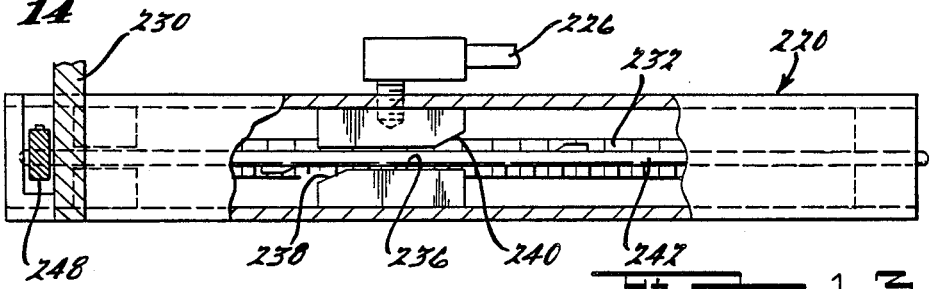
FIG. 13 is a side elevation view partially in cross-section of FIG. 11.
Figure 14:
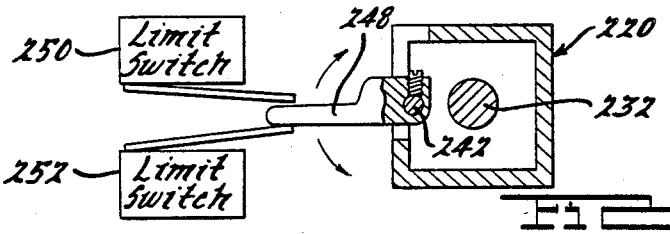
FIG. 14 is a vertical cross-section view through a plane defined by line 14–14 of FIG. 12 thereof.

The screw member 232 is threadably engaged with an actuator nut 234. The actuator nut 234 reciprocates along the longitudinal axis of the screw member 232 in response to the clockwise and counterclockwise rotation of the screw member 232. The actuator nut 234 has a groove 236 with flange portions 238 and 240 on each side thereof, as best seen in FIG. 13.

An actuator shaft 242 is positioned within the housing 220. The actuator shaft 242 is positioned within the groove 236 of the actuator nut 234. The actuator shaft 242 has a pair of nubs 244 and 246 positioned along the shaft 242. The nubs 244 and 246 are positioned along the circumference of the shaft 242 such that the nubs form a right angle when viewed transverse to the longitudinal axis of the shaft 242.

The shaft 242 also includes actuator arm 248 secured at one end of the actuator shaft 242. The actuator arm 248 is positioned between two limit switches 250 and 252. The limit switches work substantially the same as limit switches 82 and 84 previously described herein. As the actuator arm 248 pivots from one position to the other the limit switches 250 and 252 are actuated, as explained above.

The steering device 210 generally works as follows. The actuator nut 234 moves along the screw member 232, via the threaded engagement, within the housing 220. The actuator shaft 242 rides along in the slot 236. As the actuator nut 234 comes to the end of its travel in either direction, the flanges 238 and 240 contact nubs 244 and 246, respectively. As the flange portion 238 contacts the nub 244, the actuator shaft 242 is pivoted such that the actuator arm contacts switch 250, stopping or reversing the motor 222. An identical action occurs when flange portion 240 contacts nub 246. The shaft 242 is pivoted such that the actuator arm contacts limit switch 252, stopping or reversing the direction of the motor 222 which, in turn, stops or reverses the movement of the actuator nut 234 stopping or reversing the direction of the outboard motor 216. Thus, the steering device 210 operates substantially the same way as the steering device 10, as previously discussed.

While the above disclosure fulfills the embodiments of the present invention, it will become apparent to those skilled in the art that modifications, variations, and alterations may be made without deviating from the scope and fair meaning of the subjoined claims.

What is claimed is:

1. An auxiliary water vessel steering device for transom or auxiliary transom mounted outboard marine motors; said steering device comprising:

means for coupling said auxiliary steering device to said transom;

an elongated stationary housing fixably coupled with said means for coupling and defining a longitudinal axis;

means coupled with said elongated housing for reciprocating movement along a line defined by said longitudinal axis;

means coupled with said moving means for reciprocatingly driving said moving means along said line defined by said longitudinal axis;

rod means coupled with said moving means and said outboard motor for moving said outboard motor which, in turn, steers said vessel;

means for controlling said driving means; and means for limiting the movement of said reciprocating moving means along said line defined by said longitudinal axis, said means for limiting including a rotatably supported rod means in said stationary housing for activating said controlling means for controlling limiting movement of said reciprocating moving means.

2. The auxiliary steering device according to claim 1 wherein said reciprocating moving means includes a screw member rotatably supported in said housing and coupled with said drive means, a drive slider threadably engaged with said screw member and coupled with said rod means, said drive slider reciprocatingly moving along said line defined by said longitudinal axis in a first and a second reverse direction.

3. The auxiliary steering device according to claim 2 wherein said driving means including a reversible motor coupled with said screw member.

4. The auxiliary steering device according to claim 2 wherein said rod means coupled with said outboard motor includes a multi-directional coupling coupled with said drive slider, a tie rod having two ends one of which is coupled with said multi-directional coupling, and a quick connect coupling coupled with the other end of said tie rod and adapted to be removably coupled with said outboard motor.

5. The auxiliary steering device according to claim 2 wherein said limiting means includes a member projecting from said slider, a pair of fingers coupled with said member and projecting from said member in a direction opposite to one another, a pair of prongs projecting from said rod means and an activation member projecting from said rod means, a pair of limit switches coupled with said housing and positioned such that said activation member is positioned between said limit switches such that when said activation member is pivoted in a first direction it activates one switch and when pivoted in a second opposite direction it activates the second switch to limit the movement of said drive slider.

6. The auxiliary steering device according to claim 1 wherein said control means is of the remote type.

7. An auxiliary water vessel steering device for transom or auxiliary transom mounted outboard marine motors; said steering device comprising:

means for coupling said auxiliary steering device to said transom;

an elongated stationary housing fixably coupled with said means for coupling and defining a longitudinal axis;

a screw member rotatably supported in said housing, a drive slider threadably engaged with said screw member, said drive slider reciprocatingly moving along a line defined by said longitudinal axis in a first and second reverse direction;

means coupled with said drive slider and said outboard motor for moving said outboard motor which, in turn, steers said vessel;

means for controlling said driving means; and means for limiting the movement of said drive slider along said line defined by said longitudinal axis, said means for limiting including a rotatably supported rod means in said stationary housing for activating said means for controlling for limiting movement of said slider along said line defined by said longitudinal axis, said activating means coupled with and extending from said slider.

8. The auxiliary steering device according to claim 7 wherein said limiting means includes a member projecting from said slider, a pair of fingers coupled with said member and projecting from said member in a direction opposite to one another, a pair of prongs projecting from said rod means and an activation member projecting from said rod means, a pair of limit switches coupled with said housing and positioned such that said activation member is positioned between said limit switches such that when said activation member is pivoted in a first direction it activates one switch and when pivoted in a second opposite direction it activates the second switch to limit the movement of said drive slider.

9. The auxiliary steering device according to claim 7 wherein said rod means coupled with said outboard motor includes a multi-directional coupling coupled with said drive slider, a tie rod having two ends one of which is coupled with said multi-directional coupling, and a quick connect coupling coupled with the other end of said tie rod and adapted to be removably coupled with said outboard motor.

10. An auxiliary water vessel steering device for transom or auxiliary transom mounted outboard marine motors; said steering device comprising:

means for removably coupling said auxiliary steering device to said transom;

an elongated stationary housing fixably coupled with said coupling means and defining a longitudinal axis;

means for reciprocating movement in a first and a second reverse opposite direction along said longitudinal axis associated with said housing;

means for driving said reciprocating means in said reciprocating pattern along said longitudinal axis;

means for moving said outboard motor, said movement of said outboard motor steering said vessel, said outboard motor moving means coupled with said reciprocating means; and means for limiting movement of said reciprocating means in said first and second opposite direction along said longitudinal axis, said limiting means including a rotatable shaft means mounted within said housing and pivoting between a first and second position in response to movement of said reciprocating means such that as said reciprocating means reaches a final position in one direction, said shaft means pivots from one position to the other position stopping or reversing movement of said reciprocating means along said longitudinal axis.

11. The steering device according to claim 10 wherein said limiting means comprises a pair of nubs on said shaft means and an arm on said shaft means associated with a pair of limit switches such that said reciprocating means contacts said nubs pivoting said shaft which, in turn, pivots the arm between said switches stopping or reversing the movement of said reciprocating means along said longitudinal axis.

12. The steering device according to claim 11 wherein said reciprocating means is further comprised of a nut having a groove for following along said shaft means, said end of said groove being flanged for contacting said nubs.

* * * * *